US006768498B1

(12) United States Patent
Kim

(10) Patent No.: US 6,768,498 B1
(45) Date of Patent: Jul. 27, 2004

(54) OUT OF RANGE IMAGE DISPLAYING DEVICE AND METHOD OF MONITOR

(75) Inventor: Woong Gyu Kim, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 188 days.

(21) Appl. No.: 09/628,502

(22) Filed: Jul. 28, 2000

(30) Foreign Application Priority Data

Jul. 31, 1999 (KR) ..... P1999-31587

(51) Int. Cl.[7] ..... G09G 5/34
(52) U.S. Cl. ..... 345/698
(58) Field of Search ..... 345/698, 699; 348/444, 488, 572, 581

(56) References Cited

U.S. PATENT DOCUMENTS 5,267,331 A * 11/1993 Siwoff ..... 382/54
5,621,428 A * 4/1997 King et al. ..... 345/118
6,307,531 B1 * 10/2001 Shin ..... 345/88
2002/0067351 A1 * 6/2002 Kim ..... 345/204

* cited by examiner

*Primary Examiner*—Matthew C. Bella
*Assistant Examiner*—G. F. Cunningham

(74) *Attorney, Agent, or Firm*—Fleshner & Kim, LLP

(57) ABSTRACT

An image displaying device and method of a monitor is provided, which is capable of providing a normal display, even when the resolution of input image signals exceeds the resolution supported in the monitor. The displaying device includes an A/D converter for converting analog image signals into digital image signals composed of even pixels, odd pixels and even/odd pixels in accordance with a sampling clock set by a control signal; a delayer for delaying a horizontal synchronizing signal for a predetermined time; a switch for selecting one of the horizontal synchronizing signal delayed for the predetermined time by the delayer and a normal horizontal synchronizing signal to generate the sampling clock of the A/D converter in accordance with a switching signal; a memory for temporarily storing the digital image signals in a frame unit; a video scaler for storing the even and odd pixels digital image signals outputted from the A/D converter in the memory to thereby build one frame and transmitting the stored output to match with a signal input timing of a display module; and a microcomputer to output a switching signal to switch the switch in synchronism with the vertical synchronizing signal, if the resolution of the input image is over the resolution supported in the monitor, and at the same time outputs a control signal to set the sampling clock of the A/D converter to half a normal sampling clock.

16 Claims, 4 Drawing Sheets

OUT OF RANGE IMAGE DISPLAYING DEVICE AND METHOD OF MONITOR

BACKGROUND OF THE INVENTION

1. Field of the Invention

The present invention relates to a monitor and more particularly, to an out of range image displaying device and method of a monitor.

2. Background of the Related Art

A monitor typically executes a series of signal processing operations, such as digital sampling, scaling, and the like for image signals of a predetermined format transmitted from a source, such as a video card of a personal computer connected to the monitor. The monitor then displays the processed image signals on a screen.

Large display devices are presently under development using current technology. Accordingly, the monitor has progressed from a small monitor using a cathode-ray tube into a digital system using a liquid crystal display (LCD) as a representative flat display device adequate to the large monitor.

The image display performance of the monitor is determined by its resolution, which is divided into SVGA (800×600), XGA (1024×768) and SXGA (1280×1024).

As shown in FIG. 1, an image processing device of a monitor in the related art includes an A/D converter 1 for converting analog R, G, and B image signals transmitted from a video card into 8-bit digital R, G, and B image signals according to a predetermined sampling clock, which is synchronous with a horizontal synchronizing signal H-sync controlled by a control signal of a microcomputer 4. A buffer 2 is further provided for temporarily storing the digital R, G, and B image signals in a frame unit, and a video scaler 3 converts the digital R, G, and B image signals outputted from the A/D converter 1 into the signals in a frame unit, which can be displayed on an LCD module. The converted image signals are stored in the frame buffer 2 and transmitted so as to match an input timing signal of the LCD module. Finally, microcomputer 4 recognizes an input image format in accordance with horizontal and vertical synchronizing signals H-sync and V-sync transmitted from the video card, and outputs the control signal to both the A/D converter 1 and the video scaler 3, so as to match the display with the corresponding format.

In operation, if the analog R, G, and B image signals and the horizontal and vertical synchronizing signals are inputted from the video card, the microcomputer 4 first recognizes the resolution of the inputted image signals, namely, SVGA, XGA and SXGA by using the horizontal/vertical synchronizing signals.

Then, the microcomputer 4 applies the control signal to set the sampling clock of the A/D converter 1 for the digital conversion. The sampling clock is set to correspond to the resolution set by a user, in case where the resolution of the input image signals is below the resolution supported in the monitor, for example, when the resolution of the monitor is XGA (1024×768) and the resolution of the input image signals is XGA or VGA.

In response to the control signal, the A/D converter 1 generates the sampling clock of 95 MHz to sample the XGA image signals to match with the horizontal synchronizing signal timing. It also executes the digital sampling for the input image signals, and outputs the 8-bit digital R, G, and B image signals. At the same time, the A/D converter 1 outputs a dot clock Dot Clock for recognizing the signal of the video scaler 3.

The video scaler 3 then stores the output of the A/D converter 1 in a frame unit, matching the resolution of XGA in the frame buffer 2, and outputs the stored output to the LCD module, in accordance with the control signal of the microcomputer 4.

The LCD module recognizes the 8-bit digital R, G, and B image signals outputted from the video scaler 3 according to a data enable signal D/E and an external clock OUT CLK, and displays the image signals to corresponding to the horizontal/vertical synchronizing signals.

When, however, the resolution of the monitor is XGA and the resolution of the input image signals is SXGA thus exceeding the display performance of the monitor, a sampling clock rate of 135 MHz is required to convert the SXGA image signals into the digital signals.

When the monitor has a resolution of XGA, it can only generate a maximum sampling clock rate of 100 MHz. It thus fails to display the input image signals on the screen, and instead displays the "out of range" on screen display (OSD).

Since the related art monitor cannot display the input image when the input image signals are out of range of the monitor, a problem arises in that the monitor should be replaced by a new monitor that supports the input image mode in order for a user to view the corresponding image.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention to provide an out of range image displaying device and method of a monitor capable of achieving a normal display even when the resolution of input image signals exceeds the resolution supported in the monitor.

Another object of the present invention is to provide a device and method of displaying video data having a first format on a monitor having a second format.

To achieve these objects and other advantages in whole or in parts, there is provided an out of range image displaying device of a monitor, which includes an A/D converter for converting analog image signals into digital image signals composed of even pixels, odd pixels, and even/odd pixels in accordance with a sampling clock set by a control signal; a delayer for delaying a horizontal synchronizing signal for a predetermined time; a switch for selecting one of the horizontal synchronizing signal delayed for the predetermined time by the delayer and a normal horizontal synchronizing signal to generate the sampling clock of the A/D converter in accordance with a switching signal; a memory for temporarily storing the digital image signals in a frame unit; a video scaler for storing the even and odd pixels digital image signals outputted from the A/D converter in the memory to thereby build one frame and transmitting the stored output to match with a signal input timing of a display module; and a microcomputer for outputting the switching signal to switch the switch in synchronism with the vertical synchronizing signal, if the resolution of the input image is over the resolution supported in the monitor and at the same time outputting the control signal for setting the sampling clock of the A/D converter to half a normal sampling clock.

To achieve these objects and other advantages in whole or in parts, there is further provided an out of range image displaying method of a monitor, which includes determining whether the resolution of external input image signals is out of range of the monitor; if the resolution of external input image is out of range of the monitor, sampling even or odd pixels for each of the image signals inputted before and after the input of a vertical synchronizing signal; and building each frame with the even and odd pixels sampled in the image signals inputted before and after the input of the vertical synchronizing signal and displaying the frame.

To further achieve the above-described objects of the present invention in a whole or in parts, there is provided an image displaying device that includes an A/D converter to convert image signals of a first format into image signals of a second format, a pixel switch that divides the digital image signal into a plurality of first pixels and a plurality of second pixels, a delay circuit to delay a horizontal synchronizing signal for a prescribed period of time, a switch to select one of the horizontal synchronizing signal and a delayed horizontal synchronizing signal in accordance with a switching signal, a video scaler building a frame from at least one of the first and second pixels of the digital image signals outputted from the pixel switch.

To further achieve the above-described objects of the present invention in a whole or in parts, there is provided a method of displaying images on a monitor that includes determining whether the resolution of external input image signals exceeds that of the monitor, setting a sampling clock, sampling even or odd pixels for each of the image signals inputted before and after the input of a vertical synchronizing signal, and building each frame using at least one of the even and odd pixels sampled in the image signals inputted before and after the input of the vertical synchronizing signal and displaying the frame.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The configuration and operation of an out of range image displaying device and method of a monitor as embodied and broadly described according to the present invention will be hereinafter described with reference to FIGS. 2, 3, and 4.

Figure 1:
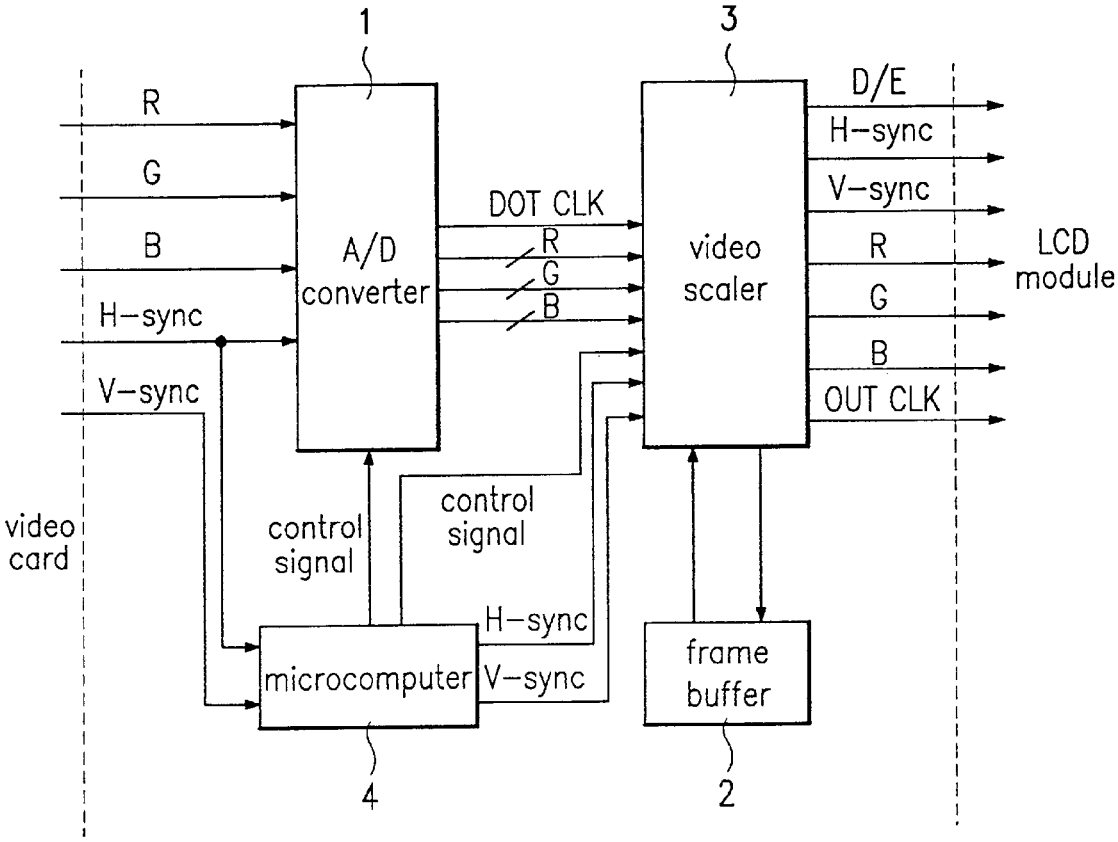
FIG.1 Prior Art
FIG. 1 is a block diagram illustrating the configuration of an image processing device of a monitor in the related art.
Figure 2:
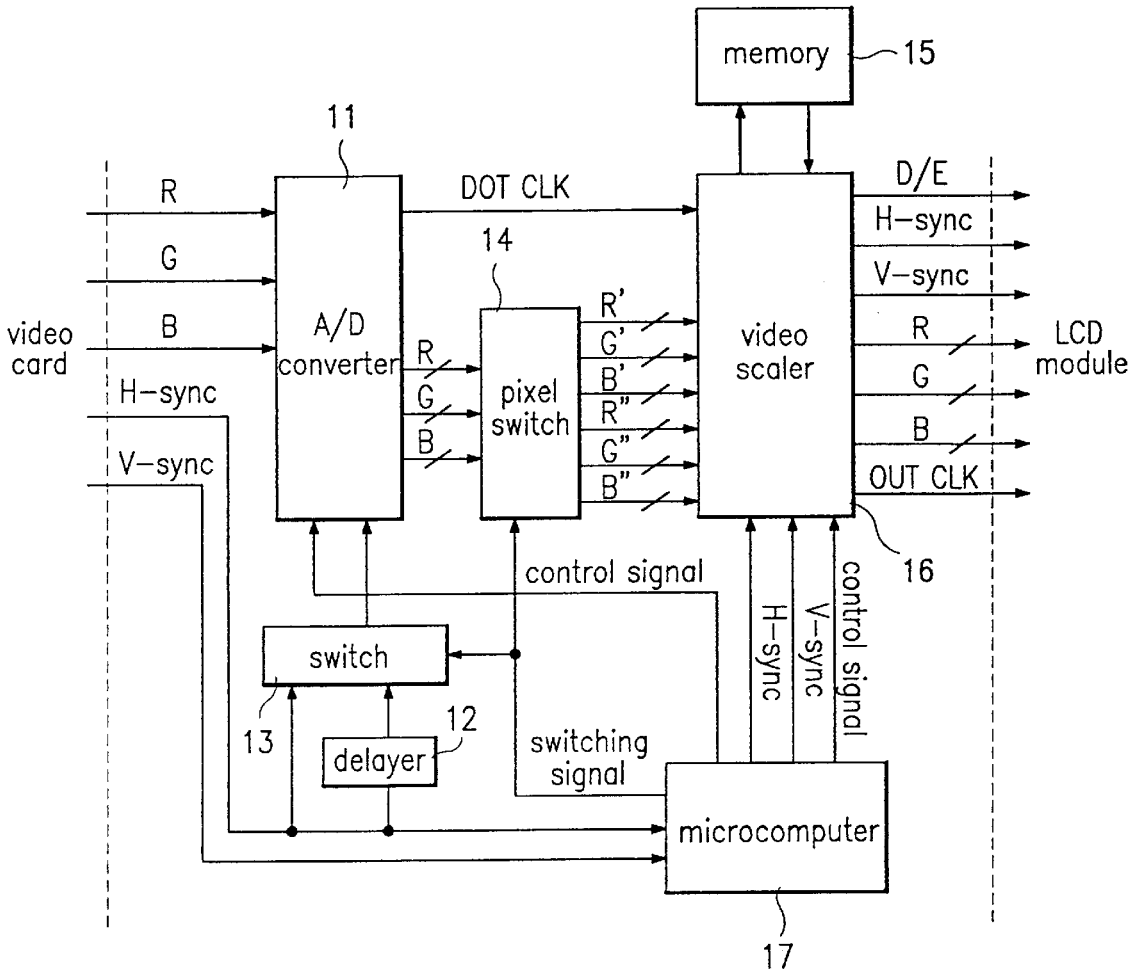
FIG. 2 is a block diagram illustrating the configuration of an out of range image displaying device of a monitor according to a preferred embodiment of the present invention.

Referring to FIG. 2, an out of range image displaying device of a monitor according to the preferred embodiment includes an A/D converter 11 for converting analog R, G, and B image signals transmitted from a video card into 8-bit digital R, G, and B image signals. The digital R, G, and B image signals are preferably composed of even pixels, odd pixels, and even/odd pixels, in accordance with a sampling clock set by a control signal of a control circuit 17, such as a microcomputer.

Next, a delay circuit 12 delays a horizontal synchronizing signal for a prescribed period of time, and a switch 13 selects one of the delayed horizontal synchronizing signal and the normal horizontal synchronizing signal. The switch 13 transmits the selected signal as a timing signal for generating the sampling clock of the A/D converter 11 in accordance with a control signal of the microcomputer 17.

A pixel switch 14 is further provided to output the even pixels and odd pixels of the 8-bit digital R, G, and B image signals, which are outputted sequentially from the A/D converter 11, to each path in accordance with a control signal of the microcomputer 17. A video scaler 16 stores the even and odd pixels 8-bit digital R, G, and B image signals outputted to each path through the pixel switch 14 to build one frame in the frame buffer 15, which temporarily stores the digital R, G, and B image signals in a frame unit. The video scaler 16 then transmits the stored image signals to match with a signal input timing of an LCD module.

The microcomputer 17 recognizes the resolution of the input image according to the horizontal and vertical synchronizing signals transmitted from the video card, and if the resolution of the input image is higher than the resolution supported in the monitor, outputs the control signal for switching the switch 13 and the pixel switch 14 in synch with the vertical synchronizing signal. At the same time, it outputs a control signal for setting the sampling clock of the A/D converter 11 to half a normal sampling clock.

Under the above construction, a description of an out of range image displaying method of a monitor according to a preferred embodiment of the present invention will be described.

Figure 3:
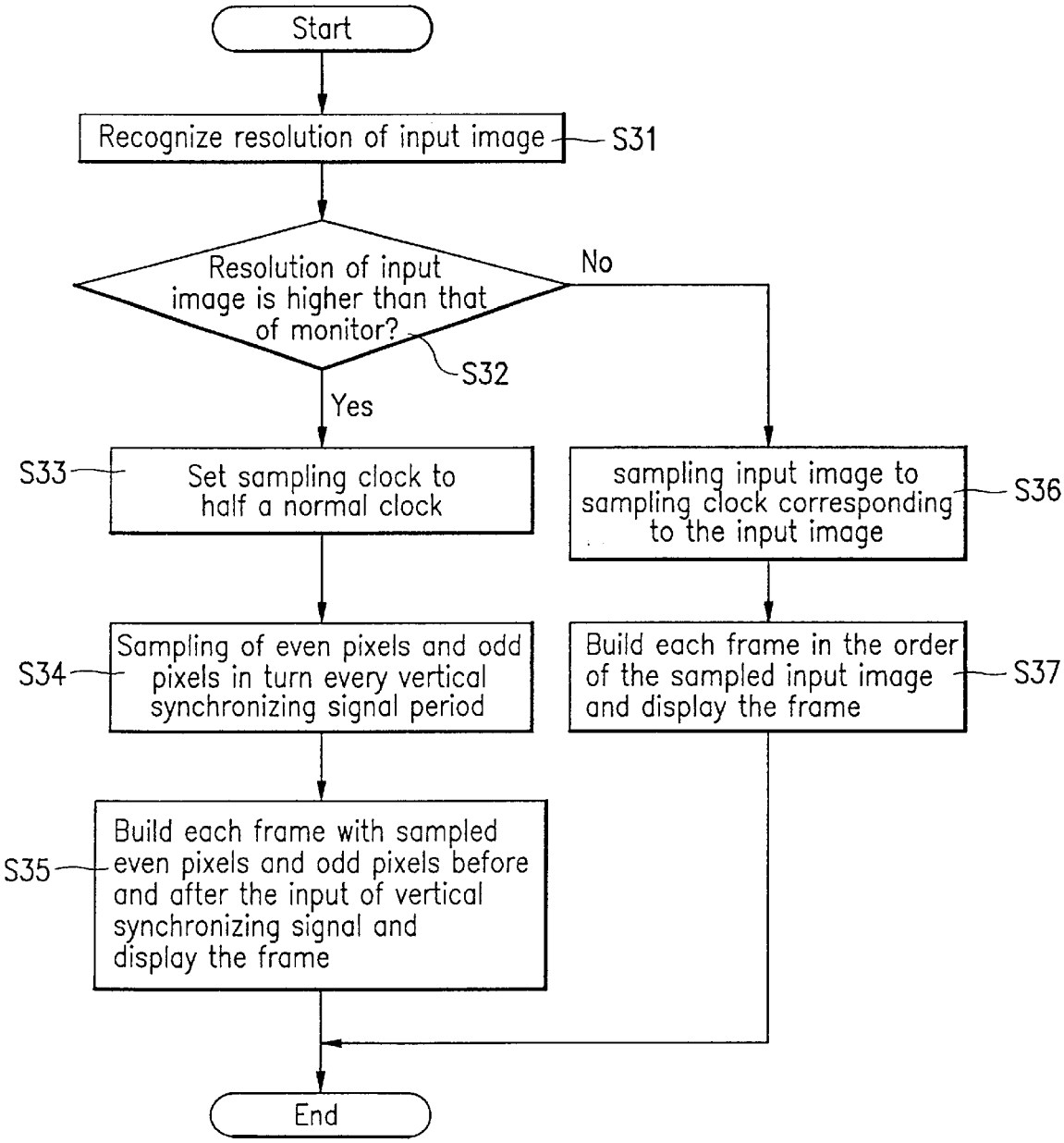
FIG. 3 is a flowchart illustrating an out of range image displaying method of a monitor according to a preferred embodiment of the present invention.

Referring to FIG. 3, if the analog R, G, and B image signals and the horizontal and vertical synchronizing signals are inputted from the video card, the microcomputer 17 recognizes the resolution of the input image signals, that is, SVGA, XGA or SXGA by using the horizontal/vertical synchronizing signals (Step S31).

Then, the microcomputer 17 determines whether the resolution of the input image signals is higher than the resolution supported in the monitor (Step S32).

If it is determined that the resolution of the input image signals is higher than the resolution supported in the monitor, for example, if the resolution of the monitor is XGA (1024×768) and that of the input image signals is SXGA (1280×1024), the microcomputer 17 outputs the control signal to the A/D converter 11 and sets the sampling clock to half a normal sampling clock of 135 MHz required for converting the SXGA image to the digital signals, that is, to the clock of 67.5 MHz (Step S33).

Figure 4:
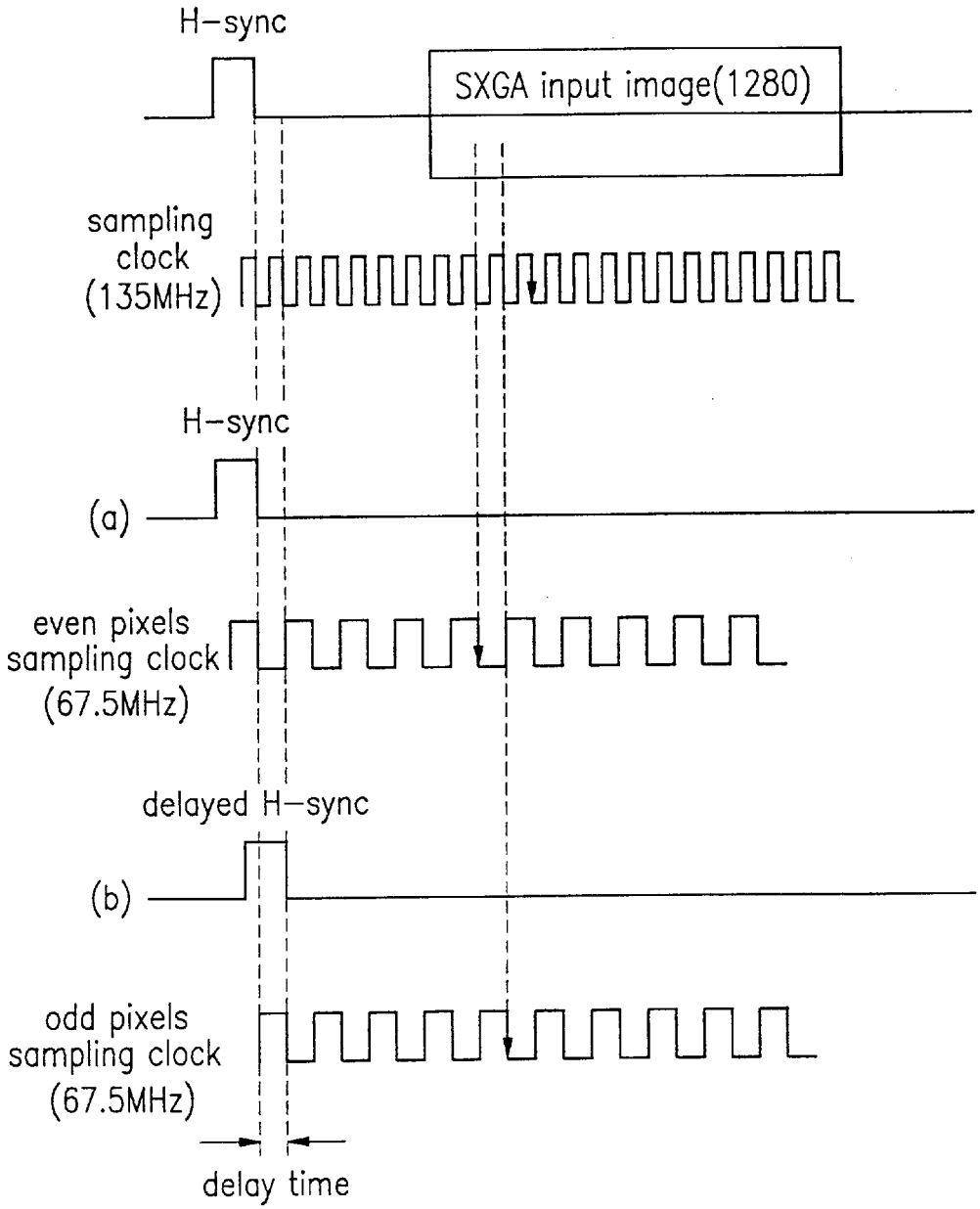
FIG. 4 is a timing diagram illustrating the waveforms of the horizontal synchronizing signal and the sampling clock according to a preferred embodiment of the present invention.

Next, the A/D converter 11 samples the even pixels of the input image to build a first frame, according to the sampling clock of 67.5 MHz, synchronized with the horizontal synchronizing signal at an original state, as shown in "(a)" in FIG. 4 and converts the input image signals into the 8-bit digital R', G', and B' image signals.

If the vertical synchronizing signal is inputted, the A/D converter 11 executes the sampling for the odd pixels of the input image to build a second frame, according to the sampling clock of 67.5 MHz synchronized with the horizontal synchronizing signal delayed for a prescribed time, as shown in "(b)" in FIG. 4, and converts the input image signals into the 8-bit digital R", G", and B" image signals (Step S34). At this time, if the image signals for building the first frame are inputted, the microcomputer 17 controls the switch 13 under the output of the switching signal and inputs the horizontal synchronizing signal at the original state to the A/D converter 11.

If the vertical synchronizing signal is inputted and the image signals for building the second frame are then inputted, the microcomputer 17 controls the switch 13 under the output of the switching signal and inputs to the A/D converter 11, the delayed horizontal synchronizing signal, which is delayed in the delayer 12 for the prescribed time required for sampling the odd pixels, for example, for the half period the sampling clock of 67.5 MHz.

Since the pixel switch 14 and the switch 13 switch according to the same switching signal, the pixel switch 14 transmits the R', G', and B' image signals and the R", G", and B" image signals to the video scaler 16 via each path of the image signals.

The video scaler 16 stores the R', G', and B' image signals in the memory corresponding to the even pixels in the frame buffer 15 and the R", G", and B" image signals in the memory corresponding to the odd pixels in the frame buffer 15, so as to build one frame, and outputs the built frame to the LCD module. It thus displays the output (Step S35).

In other words, for a normal display, the sampling for only the even pixels in the image corresponding to the first frame of the image corresponding to two frames and for only the odd pixels in the image corresponding to the second frame is carried out to build one frame, thereby displaying the one frame.

The two frames are then synthesized on the normal display process to build the one frame, but a viewer cannot sense the abnormal state of the screen due to the afterglow effect of the LCD screen, such that it appears as a normal display.

On the other hand, if the resolution of the input image signals is below the resolution supported in the monitor, for example, if the resolution of the input image signals is XGA (1024×768), then the A/D converter 11 executes the sampling for the input image with the sampling clock of 95 MHz corresponding to the resolution and converts the input image into the 8-bit digital image signals (Step S36).

The microcomputer 17 then sets the sampling clock of the A/D converter 11 to 95 MHz in accordance with the control signal thereof, and controls the switch 13 in accordance with the output of the switching signal. The horizontal synchronizing signal is thusly inputted at the original state to the A/D converter 11, regarless of the input of the vertical synchronizing signal.

Finally, each frame is built with the sampled digital image signals in a sequential order and displayed through the LCD module (Step S37).

As clearly apparent from the foregoing, an out of range image displaying device and method of a monitor according to the present invention is capable of achieving a normal display even in case where the resolution of input image signals exceeds the resolution supported in the monitor at present used, thereby removing a problem that the monitor should be exchanged and improving the reliability for the product of a user.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An image display device, comprising:

an A/D converter to convert analog image signals into digital image signals;

a pixel switch that divides the digital image signals into a plurality of first digital image pixels and a plurality of second digital image pixels;

a delay circuit to delay a horizontal synchronizing signal for a prescribed period of time;

a switch to select one of the horizontal synchronizing signal and a delayed horizontal synchronizing signal in accordance with a switching signal;

a video scaler building a frame from at least one of the plurality of first and second digital image pixels outputted from the pixel switch, wherein the pixel switch divides and outputs even pixels and odd pixels of the digital image signals, and wherein the plurality of first pixels comprise the even pixels of the digital image signal, and the plurality of second pixels comprise the odd pixels of the digital image signal.

2. The device of claim 1, wherein the prescribed delay is a half period of a sampling clock of said A/D converter.

3. The device of claim 1, wherein the pixel switch outputs each of the pixels of the digital image signals, which were outputted sequentially from said A/D converter, to each corresponding path of said video scaler in accordance with a control signal of a control circuit.

4. The device of claim 3, wherein the corresponding paths of said video scaler are paths for outputting the even pixels and the odd pixels of the digital image signals to an even pixel input terminal at which the even pixels are inputted and an odd pixel input terminal at which the odd pixels are inputted, respectively.

5. The device of claim 3, wherein said pixel switch performs its switching according to the same control signal as said switch.

6. The device of claim 1, further comprising a control circuit, which outputs the switching signal to switch, said switch being in synchronism with a vertical synchronizing signal, if the resolution of the input image is higher than a resolution supported in the monitor, and which simultaneously outputs a control signal to set a sampling clock of said A/D converter to half a normal sampling clock.

7. The device of claim 1, wherein the A/D converter converts the analog image signals in accordance with a sampling clock set by a control signal, which is set by a control circuit.

8. A method of displaying images on a monitor, comprising:

determining whether a resolution of externally input image signals exceeds that of a monitor;

if the resolution of externally input image signals exceeds that of the monitor, setting a sampling clock;

sampling even and odd pixels for each of the image signals input before and after input of a vertical synchronizing signal; and building each frame using at least one of the even and odd pixels sampled in the image signals input before and after the input of the vertical synchronizing signal and displaying each frame, wherein said sampling step further comprises:

sampling the even pixels of the input image before the input of the vertical synchronizing signal; and sampling the odd pixels of the input image after the input of the vertical synchronizing signal.

9. A method of displaying images on a monitor, comprising:

determining whether a resolution of externally input image signals exceeds that of a monitor;

if the resolution of externally input image signals exceeds that of the monitor; setting a sampling clock;

sampling even and odd pixels for each of the image signals input before and after input of a vertical synchronizing signal; and building each frame using at least one of the even and odd pixels sampled in the image signals input before and after the input of the vertical synchronizing signal and displaying each frame, wherein said sampling step further comprises:

sampling the odd pixels of the input image before the input of the vertical synchronizing signal; and sampling the even pixels of the input image after the input of the vertical synchronizing signal.

10. A method of displaying images on a monitor, comprising:

determining whether a resolution of externally input image signals exceeds that of a monitor;

if the resolution of externally input image signals exceeds that of the monitor, setting a sampling clock;

sampling even and odd pixels for each of the image signals input before and after input of a vertical synchronizing signal; and building each frame using at least one of the even and odd pixels sampled in the image signals input before and after the input of the vertical synchronizing signal and displaying each frame, wherein said sampling clock setting step comprises setting the sampling clock to half a normal sampling clock for sampling the whole image.

11. A method of displaying images on a monitor, comprising:

determining whether a resolution of externally input image signals exceeds that of a monitor;

if the resolution of externally input image signals exceeds that of the monitor, setting a sampling clock;

sampling even and odd pixels for each of the image signals input before and after input of a vertical synchronizing signal; and building each frame using at least one of the even and odd pixels sampled in the image signals input before and after the input of the vertical synchronizing signal and displaying each frame, further comprising sampling the input image with a sampling clock corresponding to the resolution, and building each frame with the image signals sampled in a sequential order and displaying the frame.

12. The device of claim 1, wherein the plurality of first digital image pixels comprises even RGB pixels, and wherein the plurality of second digital image pixels comprises odd RGB pixels.

13. A method of displaying images on a monitor, comprising:

setting a sampling clock rate to a prescribed rate equal to half a normal sampling clock rate for a received video image signal;

dividing pixels of the received video image signal into even RGB pixels and odd RGB pixels;

building a first frame from the even RGB pixels using the prescribed sampling clock rate and building a second frame from the odd RGB pixels using the prescribed sampling clock rate; and forming an output frame by synthesizing the first frame and the second frame, wherein dividing pixels of the received video image signal comprises sampling the odd RGB pixels of the received video image signal before the input of a vertical synchronizing signal, and sampling the even pixels of the received video image signal after the input of the vertical synchronizing signal.

14. A method of displaying images on a monitor, comprising:

setting a sampling clock rate to a prescribed rate equal to half a normal sampling clock rate for a received video image signal;

dividing pixels of the received video image signal into even RGB pixels and odd RGB pixels;

building a first frame from the even RGB pixels using the prescribed sampling clock rate and building a second frame from the odd RGB pixels using the prescribed sampling clock rate; and forming an output frame by synthesizing the first frame and the second frame, wherein dividing pixels of the received video image signal comprises sampling the even RGB pixels of the received video image signal before the input of a vertical synchronizing signal, and sampling the odd pixels of the received video image signal after the input of the vertical synchronizing signal.

15. The method of claim 13, wherein forming an output frame comprises building each frame with the image signals sampled in a sequential order.

16. The method of claim 14, wherein forming an output frame comprises building each frame with the image signals sampled in a sequential order.

* * * * *